US005734206A

United States Patent [19]

Keizer et al.

[11] Patent Number: 5,734,206

[45] Date of Patent: Mar. 31, 1998

[54] SECURITY POWER INTERRUPT

[75] Inventors: Daniel James Keizer, Schumacher; Steven A. Lax; Robert K. Muylwyk, both of Toronto, all of Canada

[73] Assignee: Boss Control Inc., Ontario, Canada

[21] Appl. No.: 741,552

[22] Filed: Oct. 31, 1996

Related U.S. Application Data

[60] Division of Ser. No. 599,457, Jan. 22, 1996, Pat. No. 5,592,032, which is a continuation-in-part of Ser. No. 173, 046, Dec. 27, 1993, Pat. No. 5,486,725.

[51] Int. Cl.[6] ..... H01H 71/24

[52] U.S. Cl. ..... 307/116; 307/40; 307/112; 307/139; 307/142; 200/50 R; 439/304

[58] Field of Search ..... 307/116, 112, 307/40, 139, 142, 140, 38, 125; 439/304; 200/50 R; 361/170, 171

[56] References Cited

U.S. PATENT DOCUMENTS

| | | | |
|---|---|---|---|
| 1,146,016 | 7/1915 | Oppenheim et al. . | |
| 3,143,067 | 8/1964 | Rorke | 200/43 |
| 4,247,743 | 1/1981 | Hinton et al. | 200/44 |
| 4,277,659 | 7/1981 | DeRemer | 200/61.62 |
| 4,303,867 | 12/1981 | Van Der Meulen | 315/360 |
| 4,323,762 | 4/1982 | Ervin et al. | 219/482 |
| 4,348,696 | 9/1982 | Beier | 358/188 |
| 4,463,228 | 7/1984 | Osika | 200/51 |
| 4,659,909 | 4/1987 | Knutson | 219/452 |
| 4,736,195 | 4/1988 | McMurtrey et al. | 340/568 |
| 4,782,420 | 11/1988 | Holdgaard-Jensen | 361/58 |
| 4,870,531 | 9/1989 | Danek | 361/93 |
| 4,888,575 | 12/1989 | De Vaulx | 361/171 |
| 5,021,916 | 6/1991 | Hubbard | 361/171 |
| 5,070,219 | 12/1991 | Grosskrueger et al. | 200/43.008 |
| 5,071,360 | 12/1991 | Lindow et al. | 439/133 |
| 5,193,665 | 3/1993 | Jankow | 200/43.8 |
| 5,283,475 | 2/1994 | Berger | 307/125 |
| 5,434,368 | 7/1995 | Hoffmann | 200/43.22 |
| 5,434,558 | 7/1995 | Zeder | 340/568 |
| 5,488,208 | 1/1996 | Seewald | 200/43.22 |
| 5,538,218 | 7/1996 | Haas | 439/346 |

FOREIGN PATENT DOCUMENTS

| | | | |
|---|---|---|---|
| 84301352 | 10/1984 | European Pat. Off. | G07C 9/00 |
| 85201738 | 4/1987 | European Pat. Off. | G07F 15/00 |
| 88116873 | 4/1990 | European Pat. Off. | A61B 6/00 |
| 42 29 731 A1 | 4/1993 | Germany | H02B 15/00 |
| WO 85/03789 | 8/1985 | WIPO | G07C 9/00 |
| WO 89/02968 | 4/1989 | WIPO | E05B 49/00 |
| WO 93/14350 | 7/1993 | WIPO | F24C 3/12 |
| 94/00706 | 12/1994 | WIPO | G07C 9/00 |

*Primary Examiner*—William M. Shoop, Jr.
*Assistant Examiner*—Albert W. Paladini

[57] ABSTRACT

A security electrical power interrupt apparatus prevents usage of an electrical appliance such as an electric stove, or other electrically operated device. The apparatus includes a relay controlled by a micro-processor based programmable controller. The device includes a detachable component through which data is input. Data is input to the detachable component through a key pad. A software computer program operates in the controller and causes the relay to disconnect the supply power from the device if any attempt is made to operate the appliance or device in a manner which draws electrical current exceeding a preset limit while the controller is in an interrupt mode. In a preferred embodiment the controller further is programmed to enter the interrupt mode in response to 1) predetermined data input through the key pad in connection with the detachable component, 2) a selected amount of time having elapsed since the last authorized usage of the appliance or device, or 3) disconnection of the detachable component from the apparatus. The controller restores power to the appliance or device in response to the detachable component being connected to the apparatus and input of an authorization code through the key pad.

27 Claims, 4 Drawing Sheets

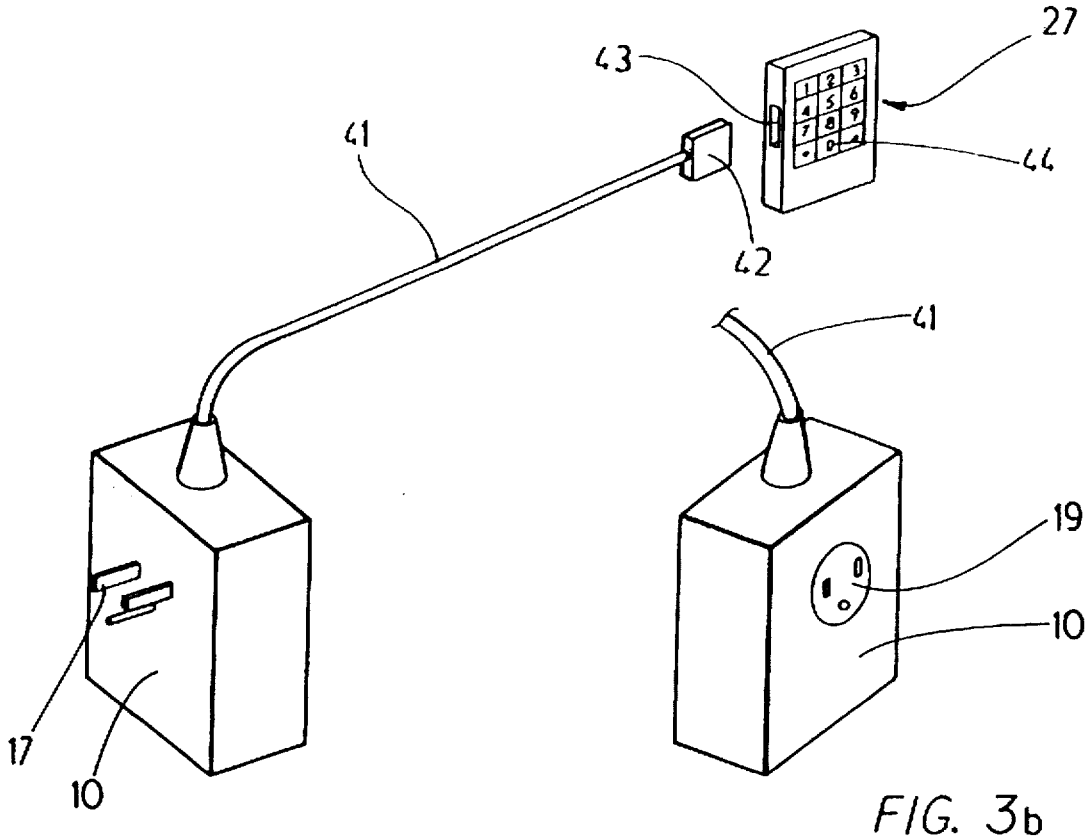
FIG. 3b
FIG. 3a
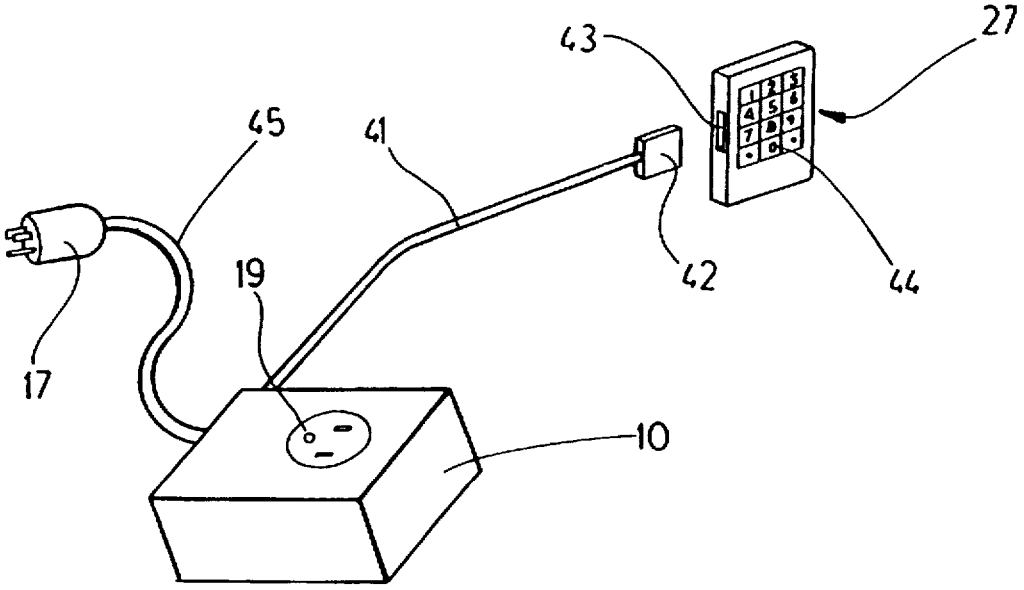
FIG. 4

SECURITY POWER INTERRUPT

CROSS REFERENCE TO RELATED APPLICATIONS

This application is a divisional application of U.S. patent application Ser. No. 08/559,457 filed Jan. 22, 1996 (now issued as U.S. Pat. No. 5,592,032), which application is a continuation-in-part application of U.S. patent application Ser. No. 08/173,046 filed Dec. 27, 1993 (now issued as U.S. Pat. No. 5,486,725).

FIELD OF INVENTION

The present invention relates to an electrical security power interrupt apparatus, and more particularly to a device that prevents and/or controls the unauthorized use of an electrical appliance or similar electrically operated device by enabling an authorized user to select a mode which will interrupt the supply power if a high current-drawing component is activated, or upon the occurrence of other conditions.

BACKGROUND OF THE INVENTION

Many household electrical appliances and other similar electrically operated devices can be hazardous if not properly used and monitored. There are many recorded instances of disastrous home fires caused by unauthorized operation of a household appliance such as a stove by children, burglars or vandals, or persons of reduced capacity or faculties such as the elderly. It is thus advantageous to be able to selectively control the use of such appliances and similar electrically operated devices. In the prior art, means have been provided to prevent unauthorized usage of electrical appliances and similar electrically operated devices, primarily through key operated electro-mechanical circuit interrupt devices. However, such devices conventionally provide for on-off control only, meaning that the device completely interrupts the flow of electrical power to the appliance while in the interrupt or "locked" state, and it connects the appliance to the electrical supply in the operative or "unlocked" state. In the case of, for example, a stove, once the supply power has been cut off auxiliary electrical equipment such as lighting and an electrical clock also ceases to function.

SUMMARY OF THE INVENTION

The present invention provides a security power interrupt apparatus for use in connection with an electrical appliance or similar electrically operated device.

In accordance with one aspect of the invention the appliance or device retains a connection to the power supply while in interrupt or "locked" mode; complete power shutoff only occurs when a preset electrical current is exceeded, thus allowing operation of the appliance's auxiliary electrical equipment while the interrupt device is in the interrupt mode.

In a preferred embodiment, the security power interrupt device of the present invention is controlled by a detachable electronic key pad or similar detachable component capable of receiving input data, whereby predetermined input data preferably input through a sequence of key strokes interrupts or restores power to the appliance or similar device. Power is preferably supplied to the key pad by a DC current transformer from a wall outlet to which the interrupt device is operatively connected, and the appliance or other device is in turn plugged into or otherwise operatively connected to the interrupt device. Also in the preferred embodiment, the key pad is connected by a wire remotely from the main body of the interrupt device, allowing flexibility in the placement of the key pad. For this purpose the key pad may be provided with a magnet, for detachably affixing the key pad to the metallic housing of the appliance, or other affixing means.

Further, the key pad is detachable from the interrupt device, and when detached prevents the interrupt device from being switched out of the interrupt mode, thereby preventing attempts to break the coded key sequence and restore normal supply power to the appliance. The interrupt device automatically switches to the interrupt mode when the correct numerical sequence is entered on the key pad, after a preset time interval has passed since the last authorized use of the appliance or when the key pad is disconnected from the interrupt device. The feature whereby the interrupt automatically switches to the interrupt mode when the key pad is detached can also be applied to any other type of power interrupt device or similar apparatus.

The present invention thus provides a device for interrupting power to an electrical appliance or similar electrically operated device, comprising means for connecting the interrupt device to an electrical power supply, means for supplying electrical power to the appliance, means for switching the interrupt device between a mode in which power is supplied to the appliance and a mode in which power to the appliance is substantially interrupted, enabling means detachably coupled to the device for activating the means for switching the device, means for monitoring the enabling means to determine when the enabling means has been detached from the device, and means for interrupting power to the appliance responsive to detachment of the enabling means.

BRIEF DESCRIPTION OF THE DRAWINGS

In drawings that illustrate by way of example only a preferred embodiment of the invention.

FIG. 3*a* is a perspective view of the device of the present invention configured for a 120 V electrical appliance, showing the main body from the rear;

FIG. 3*b* is a perspective view of the main body of FIG. 3*a* from the front;

FIG. 4 is a perspective view of an alternate embodiment of the present invention having an extension cord;

DETAILED DESCRIPTION OF THE INVENTION

Figure 1:
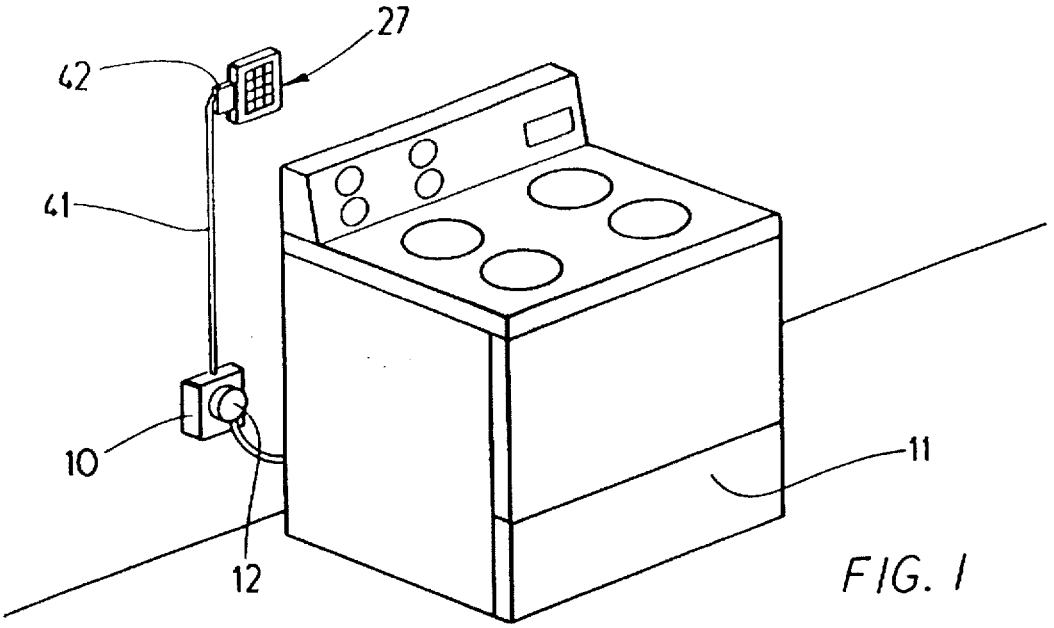
FIG. 1 is a schematic perspective view illustrating the invention connected to a 220 V electric stove, with the detachable key pad mounted on a wall.

An electrical plug 12 of an appliance 11, in the embodiment illustrated a stove operating on a 220 V household main power supply, is connected to a female socket 19 in a main body 10 of the security power interrupt device for preventing unauthorized usage of an electrical appliance. The interrupt device is in turn plugged into a 220 V wall receptacle 14, which serves as a power supply in this embodiment. In other embodiments, equivalent power supplies may be used which provide electrical energy in a form suitable for use by the electrically operated device that the interrupt device of the invention is used to control.

Figure 5:
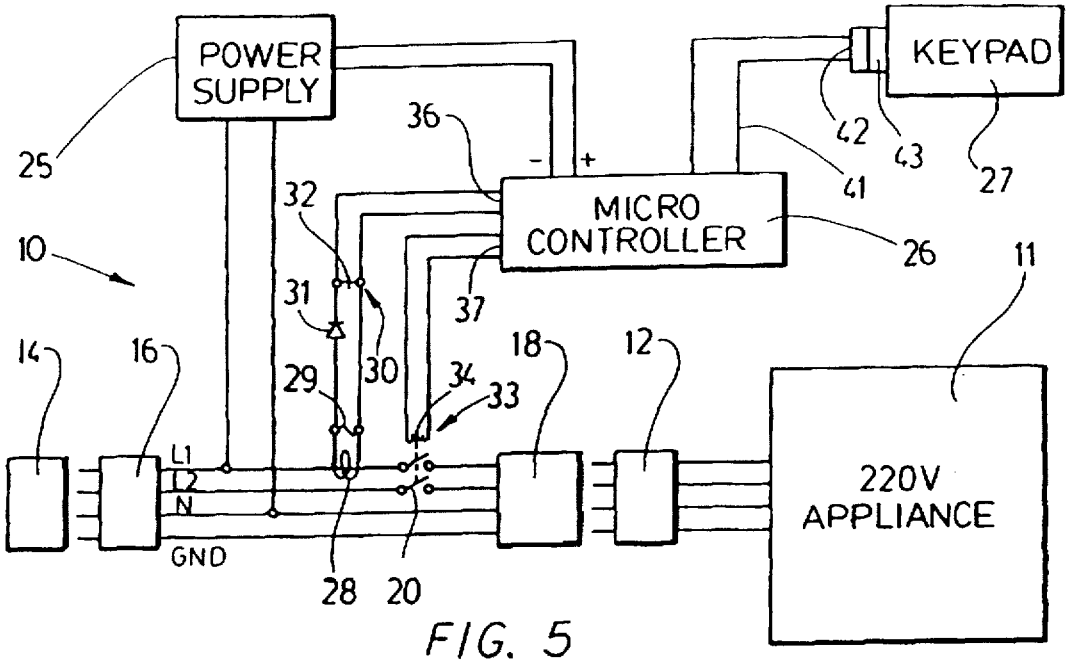
FIG. 5 is a schematic block diagram of the invention, configured to prevent unauthorized usage of a 220 V appliance, such as an electric stove.

The electrical circuitry, illustrated in FIG. 5 for a 220 V configuration of the interrupt device, is contained within the main body 10 which serves as a switching component. The interrupt device interrupts the current from the power supply to the appliance 11 when contacts 20 of a relay 33 are opened; the current from the power supply is transferred to the appliance 11 when the contacts 20 of the relay 33 are closed.

Figure 6:
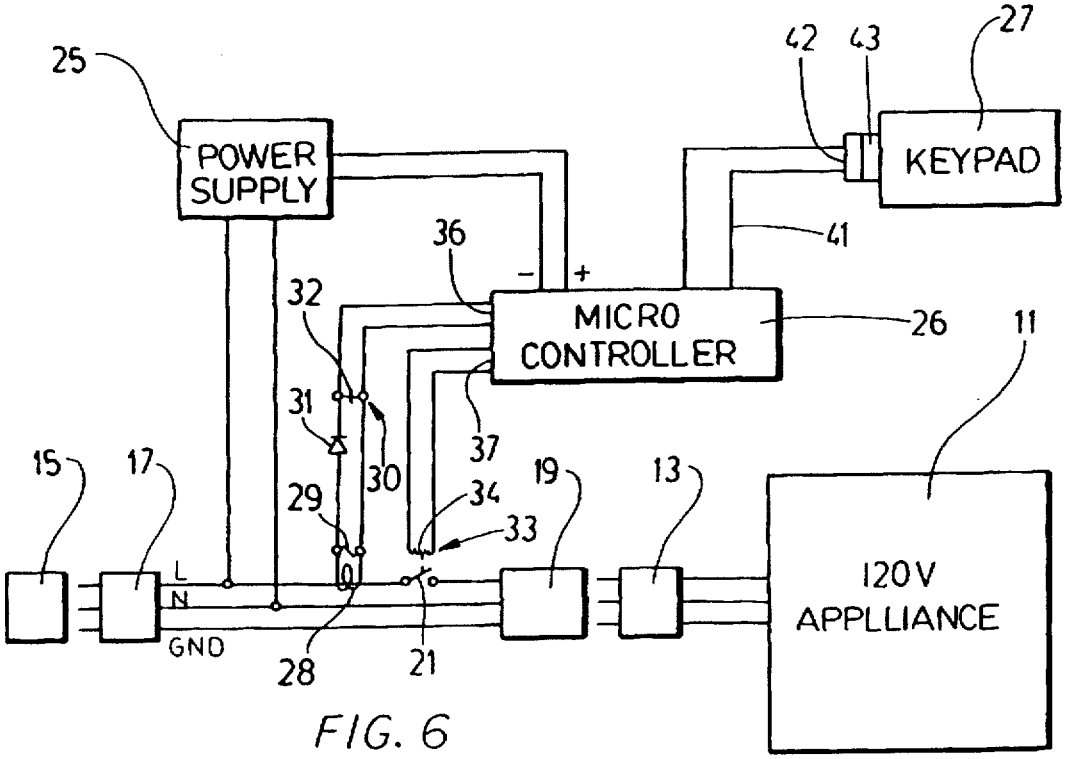
FIG. 6 is a schematic block diagram of the invention, configured to prevent unauthorized usage of a 120 v appliance, such as an electric range or space heater.

In the case of a 220 V appliance, relay contacts 21 are configured in dual-pole single-throw form, so that both voltage-carrying lines L1 and L2 are switched by the relay 33 in the case of an alternative embodiment used in connection with a 120 V appliance, as shown in FIG. 6, contacts 21 of the relay 33 are configured in single-pole single-throw form, so that the voltage-carrying line L is switched by the relay 33. In either configuration, the relay contacts, 20 or 21 must have the appropriate electrical rating for the appliance 11 or other electrically operated device that is used in connection with the invention.

The device for preventing unauthorized usage of an electrical appliance or other electrically operated device in a preferred embodiment, further comprises a DC power supply 25, which generates the direct current (DC) voltages required by a controller which in this embodiment comprises a microcontroller 26; enabling means comprising a manually operable detachable key pad 27; a current transformer 28 with a current transformer shunt 29; a rectifier circuit 30, conventionally comprised of rectifier diode 31 and filter capacitor 32; and means for switching the device between a mode in which power is supplied to the appliance and a mode in which power to the appliance is substantially interrupted comprising a relay 33 having relay coil 34 and contact sets 20 (for the 220 V embodiment of FIG. 5) or 21 (for the 120 V embodiment of FIG. 6).

FIG. 3 shows a preferred embodiment of the present invention for preventing unauthorized use of a 120 V appliance, such as an electric heater or hot plate, by way of example. The main body 10 is in the form of a closed box, directly inserted between wall socket 15 and the appliance plug 13. Thus plug 17 is inserted in wall socket 15, with appliance plug 13 inserted into the socket 19 in the main body 10. Key pad cable 41, which implements the required electrical connections between the detachable key pad 27 and the circuitry in the main body 10 of the device, has a cable connector 42 which can be connected to mating receptacle 43 which together serve as a detachable coupler. Of course, in other embodiments other equivalent devices which are capable of receiving input data and delivering such data to the remainder of the apparatus may be used in place of the key pad. Key pad 27 has a number of entry keys 44 for input of data, as is conventional for such key pads.

Figure 2:
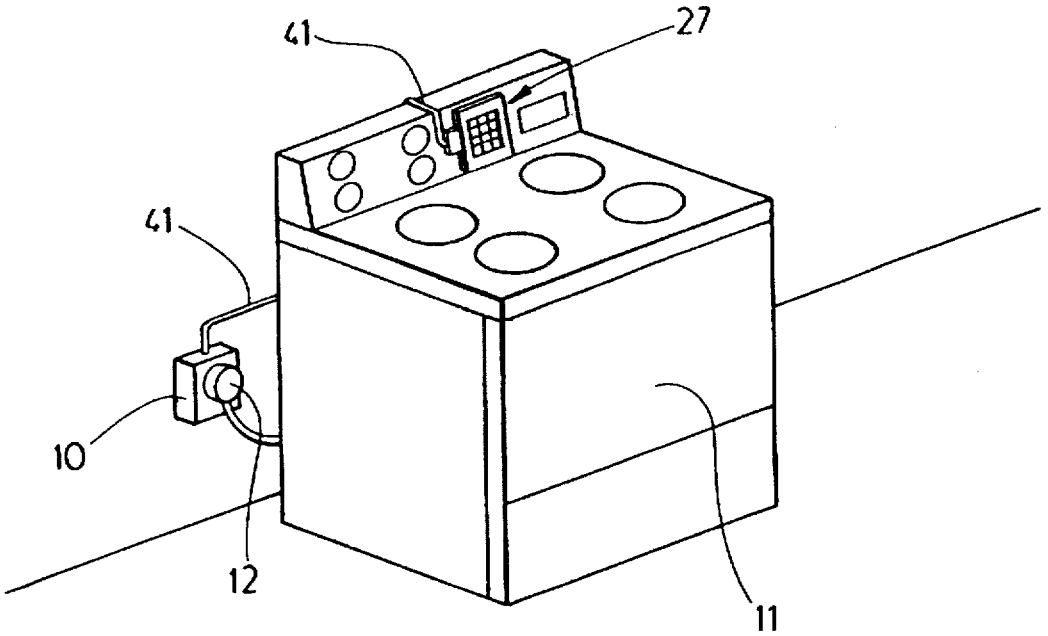
FIG. 2 is a schematic perspective view illustrating the embodiment of FIG. 1 connected to an electric stove, with the detachable key pad magnetically mounted on the stove.

In the preferred embodiment for wall mount applications, as shown in FIG. 1, key pad 27 can be mounted to the wall with detachable adhesive material, such as "Velcro" material (trademark), or with more permanent securing means. For appliance mounting applications, as illustrated in FIG. 2, key pad 27 is removably affixed to the metal body of the appliance 11 magnetically, by means of a magnet (not shown) mounted on the rear of the key pad 27.

Key pad 27 is also preferably detachable from the device. The microcontroller 26 monitors the key pad 27 as described below, and when the key pad 27 is detached from the device automatically interrupts power to the appliance 11. This feature can be adapted for use with any power interrupt device provided with conventional logic for monitoring the detachable enabling means component and switching the power interrupt to the interrupt mode when the enabling means component is detached.

FIG. 4 shows an alternate embodiment of the present invention, in which the male plug 17 is extended from the main body 10 by means of a power cord 45, similar to an electrical extension cord.

The embodiments of both FIGS. 3 and 4 are adapted for use with existing appliances, in that the appliance 11 itself does not require any alteration to utilize the device. In other embodiments the invention may be integrated in the electrical wiring of the appliance 11 or into similar electrically operated devices by the manufacturer, prior to sale to the consumer.

The microcontroller 26 of the preferred embodiment is of conventional design, having associated with it one analog input channel 36, on which it can acquire an analog input signal which is roughly proportional to the amount of electrical current drawn by the appliance 11;, one digital output channel 37, through which the microcontroller 26 can control the flow of current from the main power supply to the appliance 11 by energizing or de-energizing relay coil 34; and a key pad input for connection of detachable key pad 27.

Microcontroller 26 is electrically programmed with a software program performing the tasks which are necessary to implement the functions of the interrupt device. The software program in the preferred embodiment is a conventional multi-tasking program approach, with each task implementing a distinct function.

In the case of an electrical appliance such as a stove the software program may preferably perform the following tasks:

1) A first task is a key pad monitoring task for monitoring activity on the key pad 27. When a certain preset sequence of key strokes is input through the key pad, which input key strokes comprise a code, and this code, referred to as the "locking sequence" is received, this task sets the microcontroller to the interrupt or "locked" mode. When another preset sequence of key strokes or code is input through the key pad and is received, referred to as the "unlocking sequence" or alternatively an "authorization code", the key pad monitoring task sets the microcontroller to the operative or "unlocked" mode. The locking and unlocking codes or sequences are only known to authorized persons. If an authorized person switches the device to the operative mode while the relay contacts 20 or 21 are in the open state due to a previous unauthorized attempt to use the appliance 11, the contacts 20 or 21 are closed by degenergizing relay 33 by eliminating the voltage from relay coil 34 through digital output line 37.

The key pad monitoring task supports additional key stroke sequences or codes, in order to configure the microcontroller 26. This permits authorized persons to enter and alter the locking and unlocking sequences; to alter the current threshold at which power interrupt is engaged in the interrupt mode, to alter the "elapsed time threshold" which sets the time interval since the last authorized use following which the interrupt device will automatically enter the interrupt mode, and other system parameters as may be desired.

In addition, this task monitors whether the detachable key pad 27 is connected. When the key pad monitoring task determines that key pad 27 has been disconnected, the microcontroller 26 is automatically set to the interrupt mode. As noted above, this feature can also be applied to other power interrupt devices.

2) A second task is a current monitoring task which monitors the current drawn from the main power supply by acquiring data on analog input channel 36. When this task determines that the current drawn from the main power exceeds a preset limit, referred to as the "current threshold", if this occurs while the microcontroller is in the interrupt mode the current monitoring task will energize relay 33 by applying a voltage to the relay coil 34 through digital output line 37, thus opening relay contacts 20 or 21 and preventing transfer of supply power to the appliance 11. As noted above, when the microcontroller 26 is switched into the operative mode, this task de-energizes the relay 33 by eliminating the voltage from the relay coil 34 through digital output line 37. If the microcontroller 26 is in the operative mode, the current monitoring task monitors the electrical current drawn from the main power supply while the microcontroller 26 remains in the operative mode, in order to determine when to notify the timing task (described below) that the electrical current has been reduced to below the current threshold, and when to notify timing task that the electrical current has exceeded the current threshold.

3) A third task is a timing task. When the microcontroller 26 is in operative mode, and the current monitoring task described above notifies the microcontroller 26 that the electrical current drawn from the main power supply has just been reduced to below the current threshold, the timing task starts to count elapsed time. Similarly, when the microcontroller 26 is in the operative mode, and the timing task is in the process of counting elapsed time, and the current monitoring task notifies the timing task that the current is once more exceeding the current threshold, then the timing task will stop counting elapsed time. When the microcontroller 26 is in the operative mode, and the elapsed time counted by the timing task reaches the "elapsed time threshold" referred to above, the microcontroller 26 will change to the interrupt mode. In addition, when the microcontroller 26 is in operative mode, the timing task implements a timer mode in which the length of time that current can be drawn in excess of the current threshold is limited to a preset time. After this preset time has elapsed, the timing task returns the microcontroller 26 to the interrupt mode, which will immediately cause the current monitoring task to interrupt the main power supply as described above.

The operation of the device of the described embodiment is as follows. To use the appliance 11, an authorized person first attaches the key pad 27 if necessary to operatively couple it to the switching component and controller in the main body 10. The person then inputs the data comprising the authorization code unlocking sequence into the key pad 27. The device is thus switched to the operative mode, and the appliance 11 is fully operational. When the authorized person has finished with the appliance 11, the interrupt device is switched to the interrupt mode in one of three ways: 1) the authorized person enters the locking sequence or locking code into the key pad 27; 2) the authorized person detaches or uncouples the key pad 27 from the main body 10 by disconnecting plug 42 on cord 41 from the receptacle 43 in the key pad 27; or 3) the authorized person takes no action, in which case the timing task's timer will count time until it reaches the "elapsed time threshold".

In the preferred embodiment, when the appliance 11 is in the interrupt mode, auxiliary functions, such as a clock and/or light, remain operational, so long as their combined current draw is less than the "current threshold". When an unauthorized person attempts to use the heating functions of the appliance 11, which draw a comparatively greater current, the current threshold will be exceeded and the relay contacts 20 or 21 will be opened, disconnecting the main power supply from the appliance while still supplying power to the microcontroller 26 through DC power supply 25.

It will be understood that in the described embodiments the device in the interrupt mode does not actually cut off power to the appliance, i.e. interrupt the main power supply, until the current threshold is exceeded by turning on a high current-drawing component of the appliance 11, such as a heating element.

Thus unauthorized attempts to use the appliance in the described embodiment wherein the interrupt device is operatively connected with a stove, are immediately obvious from the fact that the auxiliary clock and light functions of the stove no longer operate. After an unauthorized use, an authorized person must connect the key pad 27, if it has been disconnected, and enter the data which comprises the unlocking sequence or authorization code to once more cause the interrupt device to supply power to the appliance to energize the auxiliary functions.

In addition, in the described embodiment, if the authorized user leaves the high current-drawing functions (for example, a heating element in a stove) on beyond a preset time, all electrical functions of the appliance 11, including auxiliary equipment, will automatically be deactivated after the preset time has elapsed unless the authorized user re-enters the unlocking sequence on the key pad 27 to restart the time elapsed timer. This feature will be of considerable comfort to persons who, after having left the premises, worry about whether or not they in fact turned an appliance off or other electrically operated device to which the invention is operatively connected.

In a further alternative embodiment of the invention, in addition to the timing function the device is provided with sound-sensing means responsive to an audible signal emitted from a smoke detector in the vicinity of the device. In the event that the smoke detector is triggered, the audible alarm immediately triggers the device to deactivate the appliance or other connected electrical device.

In a still further alternative embodiment the device is provided, preferably integral with or adjacent to the key pad 27, with a photosensor adjusted to be triggered by an open flame in the vicinity of the device. In this situation, if an open flame develops during use of an appliance such as a stove, the device automatically cuts power to the appliance.

In a still further alternative embodiment of the invention the device is provided with a motion detector. The timing task of the microcontroller 26 is initiated when the motion detector fails to detect any motion in the vicinity of the appliance, and is reset when the motion detector detects motion in the vicinity of the appliance 11. In this fashion, the timing task would count elapsed time commencing from the last moment that a user was near the appliance 11 or other device to which the invention is operatively connected. If the user returns to the appliance before the preset elapsed time threshold, the microcontroller 26 will stop counting elapsed time and reset the timing task. If the user does not return to the appliance before the elapsed time threshold has been reached, the appliance 11 is automatically deactivated as set out above. If desired, an audible alarm can sound at intervals while the microcontroller 26 is counting elapsed time, to remind the user that the appliance 11 is on. The timing task would also be reset to zero when the appliance 11 is manually turned off by the user.

Figure 7:
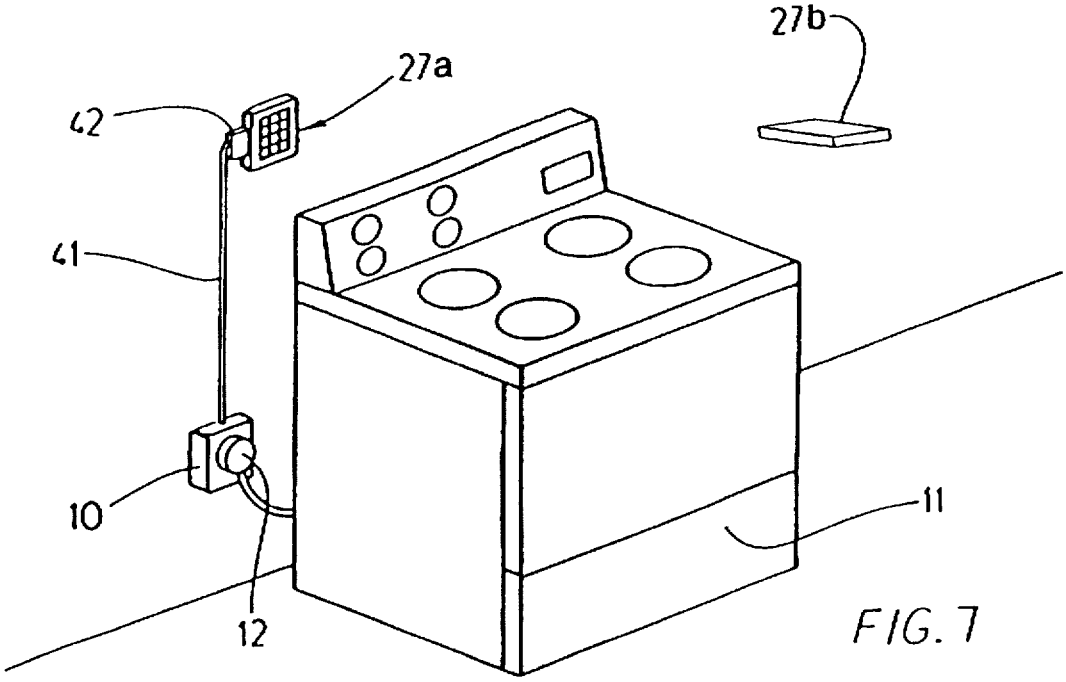
FIG. 7 is a schematic perspective view illustrating an embodiment of the invention utilizing a remote control device.

In a still further alternative embodiment of the invention the key pad 27 can comprise a conventional remote control device **27*b* shown schematically in FIG. 7, the receiver 27*a*** for which is mounted on or near the appliance as described above, with detachable adhesive material or permanent securing means. In this embodiment, if a fire develops during operation of an appliance such as a stove, the user can deactivate the appliance from a safe distance by transmitting a signal to the receiver with the remote control device, without the need to approach the appliance and risk injury.

The invention having been thus described with reference to preferred embodiments only, it will be appreciated by those skilled in the art that certain modifications and adaptations may be made without departing from the scope of the invention, as set out in the appended claims.

Thus the new security power interrupt apparatus of the present invention achieves the above-stated objectives; eliminates difficulties encountered in the use of prior devices, systems and methods; solves problems; and attains the desirable results described herein.

In the foregoing description certain terms have been used for brevity, clarity and understanding, however no unnecessary limitations are to be implied therefrom because such terms are for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means capable of performing the recited function and not the particular means shown in the foregoing description or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods, processes and relationships are set forth in the appended claims.

We claim:

1. An apparatus that interrupts delivery of electrical power from a power supply to an electrically operated device, comprising:

an electrical switching component, wherein said switching component is selectively changeable between a first condition wherein said switching component transmits power from said supply to said device, and a second condition wherein transmission of power from said supply to said device is interrupted;

a detachable component, wherein said detachable component is operative to accept input data, wherein said input data includes at least one authorization code;

a coupler, wherein said coupler detachably operatively connects said detachable component and said switching component, and wherein said switching component is in said first condition responsive to said detachable component being coupled to said coupler and said data including said authorization code, and wherein said switching component is in the second condition responsive to either said detachable component being disconnected from said coupler or said data not including said authorization code.

2. The apparatus according to claim 1 wherein said electrical switching component comprises a controller, and wherein said controller is programmable.

3. The apparatus according to claim 1 wherein said coupler comprises a detachable electrical connector, whereby said electrical connector detachably connects the detachable component and said switching component.

4. The apparatus according to claim 1 wherein said electrical switching component includes a pair of relatively movable electrical contacts, wherein in said first condition said contacts are engaged and in said second condition said contacts are separated.

5. The apparatus according to claim 1 wherein said electrical switching component includes a relay.

6. The apparatus according to claim 1 wherein said detachable component is operatively connectable with a key pad and wherein said authorization code is input through said key pad.

7. An interrupt system which is operative to interrupt the transmission of power from a power supply to an electrical load, comprising:

a controller, wherein said controller is operative to selectively supply or interrupt power to the load, a code-providing device detachably operatively connected with the controller, wherein said code-providing device is operable to provide an authorization code to said controller when operatively connected thereto, and wherein said controller is operative to supply power to the load responsive to the code-providing device providing said authorization code to the controller, and wherein the controller is operative to monitor the operative connection with said code-providing device, and wherein said controller is operative to interrupt power to the load responsive to said code-providing device being operatively disconnected from said controller.

8. The system according to claim 7 and further comprising a coupler, wherein said coupler is operative to releasably electrically connect said controller and said code-providing device.

9. The system according to claim 7 wherein said code-providing device is operatively connectable with a key pad, and wherein said authorization code is input through said key pad.

10. The system according to claim 7 and further comprising a pair of relatively movable electrical contacts, wherein one of said contacts is operatively connected to said supply and the other of said contacts is connected to the load, and wherein said controller is operative to supply or interrupt power by selectively causing said contacts to engage and disengage, respectively.

11. The system according to claim 7 wherein said code-providing device includes a remote control device and wherein said controller is in operative connection with a receiver, wherein said receiver receives signals from said remote control device.

12. A device for interrupting power to an electrical load comprising means for connecting the device to an electrical power supply, means for supplying electrical power to the load, means for switching the device from a mode in which power to the load is interrupted to a mode in which power is supplied to the load responsive to an authorization code, detachable enabling means coupled to the device for providing the authorization code, means for monitoring the enabling means to determine when the enabling means has been detached from the device, and means for interrupting power to the load responsive to detachment of the enabling means.

13. The device of claim 12 in which the means for monitoring the enabling means comprises a controller.

14. The device of claim 12 in which the means for switching the device comprises a controller.

15. The device of claim 12 in which the means for interrupting power to the load comprises a controller.

16. The device of claim 15 in which the means for interrupting power to the load comprises a relay.

17. The device of claim 14 wherein the controller is programmable.

18. The device of claim 12 in which the enabling means comprises an electronic key pad.

19. The device of claim 12 wherein the enabling means comprises a remote control receiver.

20. An interrupt device for interrupting power to an electrical load connected to an electrical power supply, comprising a controller for switching the interrupt device between a mode in which power is supplied to the load, and a mode in which power to the load is interrupted, and an enabling device detachably coupled to the controller for providing an authorization code to the controller, wherein the controller monitors the enabling device and switches the interrupt device to the mode in which power to the load is interrupted in response to detachment of the enabling device.

21. The interrupt device of claim 20 in which the enabling device comprises an electronic key pad.

22. The interrupt device of claim 20 in which the enabling device comprises a remote control receiver.

23. The device of claim 20 in which power to the load is interrupted through a relay.

24. An interrupt device for interrupting power to an electrical load connected to an electrical power supply, comprising a controller for selectively supplying or interrupting power to the load, and a code providing device wherein said code providing device provides an authorization code to the controller, for switching the interrupt device to a first mode in which power is supplied to the load responsive to an authorization code, wherein the code providing device is detachably coupled to the interrupt device, wherein the controller monitors the code providing device to determine when the code providing device has been detached from the interrupt device and switches the interrupt device to a second mode in which power to the load is interrupted responsive to detachment of the code providing device.

25. The interrupt device of claim 24 wherein the code providing device is operatively connectable to an electronic key pad.

26. The interrupt device of claim 24 wherein the code providing device is operatively connectable with a remote control receiver.

27. The interrupt device of claim 24 wherein power to the load is interrupted through a relay.

* * * * *